US007578755B2

(12) United States Patent
Oyama

(10) Patent No.: US 7,578,755 B2
(45) Date of Patent: Aug. 25, 2009

(54) WOOD-TYPE HOLLOW GOLF CLUB HEAD

(75) Inventor: Hitoshi Oyama, Kobe (JP)

(73) Assignee: SRI Sports Limited, Kobe (JP)

( * ) Notice: Subject to any disclaimer, the term of this patent is extended or adjusted under 35 U.S.C. 154(b) by 61 days.

(21) Appl. No.: 11/889,506

(22) Filed: Aug. 14, 2007

(65) Prior Publication Data

US 2008/0096689 A1 Apr. 24, 2008

(30) Foreign Application Priority Data

Oct. 19, 2006 (JP) ..... 2006-285348

(51) Int. Cl.
*A63B 53/04* (2006.01)

(52) U.S. Cl. ..... 473/342; 473/345; 473/350

(58) Field of Classification Search ..... 473/329, 473/342, 346

See application file for complete search history.

(56) References Cited

U.S. PATENT DOCUMENTS

| | | | | |
|---|---|---|---|---|
| 5,346,216 | A * | 9/1994 | Aizawa | 473/329 |
| 5,830,084 | A * | 11/1998 | Kosmatka | 473/349 |
| 5,954,596 | A * | 9/1999 | Noble et al. | 473/346 |
| 5,971,868 | A * | 10/1999 | Kosmatka | 473/349 |
| 6,001,030 | A * | 12/1999 | Delaney | 473/329 |
| 6,413,169 | B1 * | 7/2002 | Kosmatka | 473/329 |
| 6,904,663 | B2 * | 6/2005 | Willett et al. | 29/557 |
| 6,926,618 | B2 * | 8/2005 | Sanchez et al. | 473/329 |
| 6,997,820 | B2 * | 2/2006 | Willett et al. | 473/329 |
| 7,018,303 | B2 * | 3/2006 | Yamamoto | 473/329 |
| 7,022,029 | B2 * | 4/2006 | Caldwell | 473/324 |
| 7,022,032 | B2 * | 4/2006 | Chen | 473/346 |
| 7,066,832 | B2 * | 6/2006 | Willett et al. | 473/329 |
| 7,097,572 | B2 * | 8/2006 | Yabu | 473/329 |
| 7,101,289 | B2 * | 9/2006 | Gibbs et al. | 473/329 |
| 7,131,912 | B1 * | 11/2006 | Knuth | 473/342 |
| 7,175,540 | B2 * | 2/2007 | Sano | 473/332 |
| 7,192,365 | B2 * | 3/2007 | Souza et al. | 473/329 |
| 7,235,023 | B2 * | 6/2007 | Sugimoto | 473/291 |
| 7,258,626 | B2 * | 8/2007 | Gibbs et al. | 473/329 |
| 7,273,420 | B2 * | 9/2007 | Wright | 473/329 |
| 7,273,421 | B2 * | 9/2007 | Knuth | 473/329 |
| 7,278,925 | B2 * | 10/2007 | Oyama | 473/329 |
| 7,309,296 | B2 * | 12/2007 | Souza et al. | 473/329 |
| 7,442,132 | B2 * | 10/2008 | Nishio | 473/342 |

(Continued)

FOREIGN PATENT DOCUMENTS

JP 07204297 A * 8/1995

(Continued)

*Primary Examiner*—Alvin A Hunter
(74) *Attorney, Agent, or Firm*—Birch, Stewart, Kolasch & Birch, LLP

(57) ABSTRACT

A wood-type hollow golf club head comprises a face having a specific thickness distribution, wherein average thicknesses tUTP, tUCP, tUHP, tMTP, tMCP, tMHP, tLTP, tLCP and tLHP of an upper toe portion UTP, upper central portion UCP, upper heel portion UHP, middle toe portion MTP, middle central portion MCP, middle heel portion MHP, lower toe portion LTP, lower central portion LCP, and lower heel portion LHP, respectively, of the face satisfy the following conditions: (a) tUTP<tUCP>tUHP; (b) tMTP<tMCP>tMHP; (c) tLTP<tLCP>tLHP; (d) tUTP>tMTP<tLTP; and (e) tUHP>tMHP<tLHP, and further, in the above nine average thicknesses, (f) the largest average thickness is 2.8 to 3.5 mm; and (g) the smallest average thickness is 1.6 to 2.3 mm.

4 Claims, 6 Drawing Sheets

U.S. PATENT DOCUMENTS 7,448,960 B2 * 11/2008 Gibbs et al. ..... 473/329

FOREIGN PATENT DOCUMENTS

JP 08155060 A * 6/1996
JP 08280853 A * 10/1996
JP 09103522 A * 4/1997
JP 09192270 A * 7/1997
JP 09253243 A * 9/1997
JP 10137372 A * 5/1998
JP 11216204 A * 8/1999
JP 2000126337 A * 5/2000
JP 2000126340 A * 5/2000
JP 2001029523 A * 2/2001
JP 2001170231 A * 6/2001
JP 2002000777 A * 1/2002
JP 2002017910 A * 1/2002
JP 2002045445 A * 2/2002
JP 2002186692 A * 7/2002
JP 2002191726 A * 7/2002
JP 2002239037 A * 8/2002
JP 2002315854 A * 10/2002
JP 2002331051 A * 11/2002
JP 2003126310 A * 5/2003
JP 2003245384 A * 9/2003
JP 2003265653 A * 9/2003
JP 2004195106 A * 7/2004
JP 2004208871 A * 7/2004
JP 2004313354 A * 11/2004
JP 2005124745 A * 5/2005
JP 2005270311 A * 10/2005
JP 2006-175135 A 7/2007

* cited by examiner

E 1 section

WOOD-TYPE HOLLOW GOLF CLUB HEAD

BACKGROUND OF THE INVENTION

The present invention relates to a wood-type golf club head whose face has a specific thickness distribution capable of increasing carry distances on average.

According to the recent changes to the rules of golf, the coefficient of restitution (COR) of a wood golf club head can not be higher than 0.830. Here, the COR is measured at the center of the clubface. In the meantime, almost all golfers are, as heretofore, desirous of using wood club heads which can increase the carry distances. Thus, it is a very important theme for the golf club manufacturers these days to increase the carry distances while complying with such golf rules.

On the other hand, even in the case of professional golfers, ball hitting positions or impact points are not always the sweet spot. In the case of average golfers, especially amateur golfers, impact points are widely varied, and the possibility of off-center shots is relatively high.

SUMMARY OF THE INVENTION

It is therefore, an object of the present invention to provide a wood-type golf club head in which, by increasing the COR at off-center positions which is usually lower than the COR at the center, carry distances of off-center shots can be increased, and accordingly the average of the carry distances can be increased.

According to the present invention, a wood-type hollow golf club head comprises a face having a specific thickness distribution satisfying the following conditions:

(a) tUTP<tUCP>tUHP;

(b) tMTP<tMCP>tMHP;

(c) tLTP<tLCP>tLHP, wherein tUTP is an average thickness of an upper toe portion UTP, tUCP is an average thickness of an upper central portion UCP, tUHP is an average thickness of an upper heel portion UHP, tMTP is an average thickness of a middle toe portion MTP, tMCP is an average thickness of a middle central portion MCP, tMHP is an average thickness of a middle heel portion MHP, tLTP is an average thickness of a lower toe portion LTP, tLCP is an average thickness of a lower central portion LCP, and tLHP is an average thickness of a lower heel portion LHP, and further (d) tUTP>tMTP<tLTP; and (e) tUHP>tMHP<tLHP;

and in the above nine average thicknesses, (f) the largest average thickness is 2.8 to 3.5 mm; and (g) the smallest average thickness is 1.6 to 2.3 mm.

Here, the "average thickness" means the area weighted average thickness. Given that the objective portion is made up of small regions i (i=1, 2 - - - n) each having a thickness ti and area Si, the average thickness is $\Sigma(ti \times Si)/\Sigma Si$, (i=1, 2 - - - n). Thus, the average thickness may be considered as the volume of the objective portion divided by the total area ($s=\Sigma Si$). The thickness is as shown in FIG. 10 measured perpendicularly to the clubface 2.

The upper toe portion UTP, upper central portion UCP, upper heel portion UHP, middle toe portion MTP, middle central portion MCP, middle heel portion MHP, lower toe portion LTP, lower central portion LCP, and lower heel portion LHP are nine portions of the face 3, as shown in FIG. 3, sectioned by two horizontal planes H1 and H2 and two vertical planes V1 and V2 in a formation of a double cross when viewed from the front or rear of the head, wherein the two horizontal planes H1 and H2 are positioned to divide the backside height H into three equal parts, and the two vertical planes V1 and V2 are positioned to divide the backside width W into three equal parts.

The backside height H is the maximum height of the backside 3*i* of the face 3 measured in the up-and-down direction.

The backside width W is the maximum width of the backside 3*i* of the face 3 measured in the toe-heel direction.

In this specification, the dimensions refer to the values measured under the standard state of the club head unless otherwise noted.

The standard state of the club head is such that the club head is set on a horizontal plane HP so that the axis SL of the clubshaft (not shown) is inclined at the lie angle alpha while keeping the center line SL on a vertical plane VP, and the clubface 2 forms its loft angle beta. Incidentally, in the case of the club head alone, the center line CL of the shaft inserting hole 7*a* can be used instead of the axis SL of the clubshaft.

The sweet spot SS of the clubface 2 is the point of intersection between the clubface 2 and a straight line N drawn normally to the clubface 2 passing the center of gravity G of the head.

The back-and-forth direction is a direction parallel with the straight line N projected on the horizontal plane HP.

The heel-and-toe direction is a direction parallel with the horizontal plane HP and perpendicular to the back-and-forth direction.

The up-and-down direction is a direction perpendicular to the horizontal plane HP, namely, the vertical direction.

If the edge (2*a*, 2*b*, 2*c* and 2*d*) of the clubface 2 is unclear due to smooth change in the curvature, a virtual edge line (Pe) which is defined, based on the curvature change, is used instead as follows. AS shown in FIGS. 9(A) and 9(B), in each cutting plane E1, E2 - - - including the straight line N extending between the sweet spot SS and the center G of gravity of the head, as shown in FIG. 9(B), a point Pe at which the radius (r) of curvature of the profile line Lf of the clubface first becomes under 200 mm in the course from the center SS to the periphery of the clubface is determined. Then, the virtual edge line is defined as a locus of the points Pe.

Further, in each of the cutting planes E1, E2 - - - , a normal line M is drawn at each of the points Pe as shown in FIG. 10, so as to intersect with the backside 3*i* of the face 3, and the intersecting point (e) is determined. Then, similarly to the clubface edge, the edge 3L of the backside 3*i* is defined as a locus of the points (e).

The above-mentioned backside height H is, more specifically, a vertical distance between the highest point P3 and lowermost point P4 on the edge 3L of the backside 3*i*. The backside width W is a distance in the toe-heel direction between a toe-side extreme end-point P1 and a heel-side extreme end-point P2 on the edge 3L of the backside 3*i*.

DESCRIPTION OF THE PREFERRED EMBODIMENTS

Figure 1:
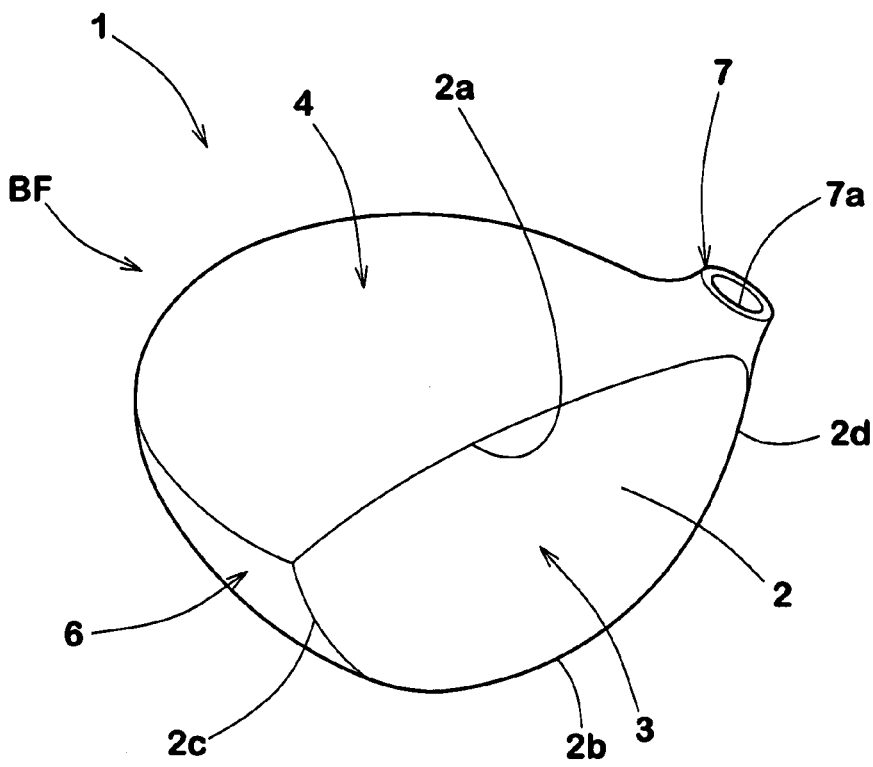
FIG. 1 is a perspective view of a wood-type golf club head according to the present invention.
Figure 2:
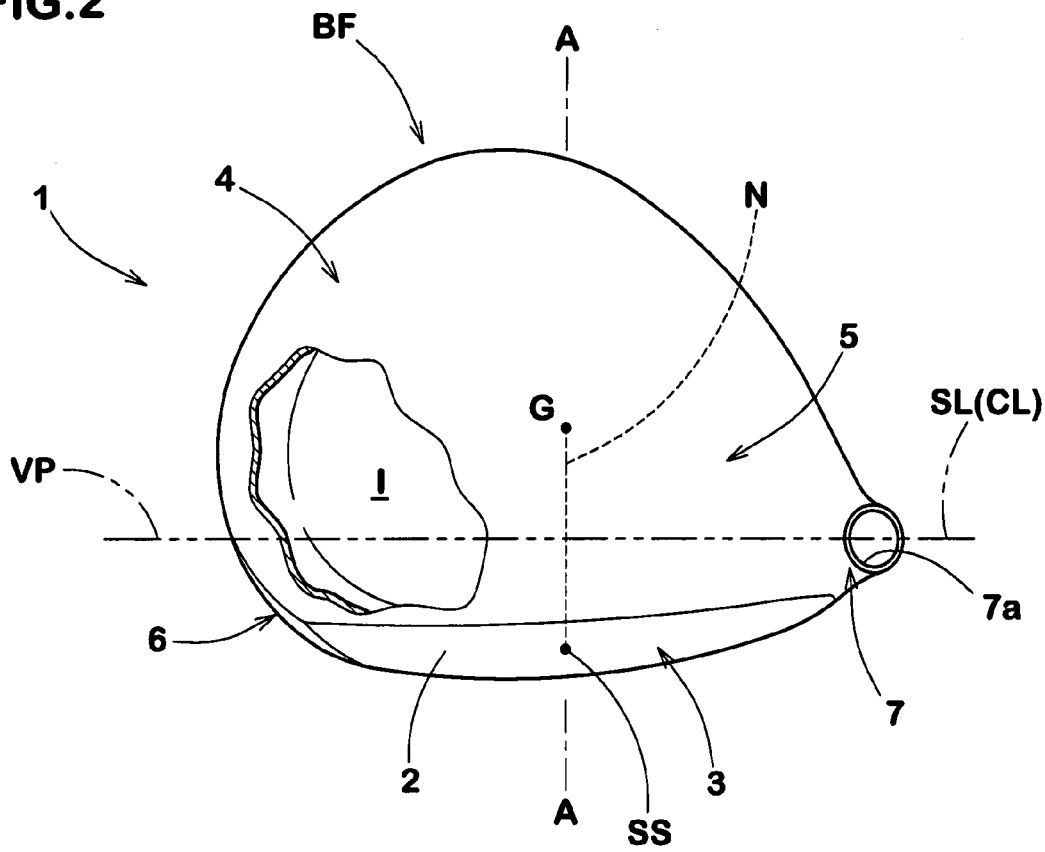
FIG. 2 is a top view thereof.

In the drawings, wood-type hollow golf club head 1 according to the present invention is a driver (#1 wood) head comprises: a face 3 whose front face defines a clubface 2 for striking a ball; a crown 4 intersecting the clubface 2 at the upper edge 2*a* thereof; a sole 5 intersecting the clubface 2 at the lower edge 2*b* thereof; a sidewall 6 between the crown 4 and sole 5 which extends from a toe-side edge 2*c* to a heel-side edge 2*d* of the clubface 2 through the back face BF of the club head; and a hosel portion 7 at the heel side end of the crown to be attached to an end of a club shaft (not shown) inserted into the shaft inserting hole 7*a*. The head 1 is provided with a hollow (I) and a shell structure with the thin wall. The hollow (I) in this example is a closed void space, but it may be filled with a foamed plastic, leaving a space from the backside of the face 3.

In the case of a driver, it is preferable that the head volume is set in a range of not less than 380 cc, more preferably not less than 400 cc, still more preferably 420 cc in order to increase the depth of the center of gravity and the moment of inertia around a vertical axis passing through the center of gravity G. However, to prevent an excessive increase in the club head weight and deteriorations of swing balance and durability and further in view of golf rules or regulations, the head volume is preferably set in a range of not more than 470 cc, preferably not more than 460 cc.

The mass of the club head 1 is preferably set in a range of not less than 180 grams, more preferably not less than 185 grams in view of the swing balance, carry distance and strength or durability, but not more than 220 grams, more preferably not more than 215 grams in view of the directionality and traveling distance of the ball.

In order to obtain sufficient rebound performance and allow the center G of gravity to locate in a suitable position, the backside width W which is almost same as the clubface width is set in a range of not less than 90 mm, preferably not less than 93 mm, more preferably not less than 95 mm, but less than 125 mm, preferably not more than 122 mm, more preferably not more than 120 mm, and the backside height H which is almost same as the clubface height is set in a range of not less than 30%, preferably not less than 32%, but not more than 75%, preferably not more than 72% of the backside width W.

The clubface 2 may be a flat surface, but in this example, the clubface 2 is a slightly curved surface protruding frontward such as a part of a spherical surface whose center is positioned rearwards of the center G of gravity of the head. The clubface 2 can be provided with grooves or punch marks which are excluded from the considerations of the profile line Lf of the clubface 2 and the thickness of the face 3.

It is possible that the club head 1 has a three or four-piece structure. In this embodiment, however, the club head 1 has a two-piece structure made up of a metallic face plate 1A forming a major part of the face 3 at least, and a main body 1B forming the remaining part of the head.

In this embodiment, the face plate 1A has its main portion forming the entirety of the face 3, and the face plate 1A is provided along the edges 2*a*, 2*b*, 2*c* and 2*d* of the clubface 2 with a turnback 9 extending backwards of the club head.

The turnback 9 is integrally formed with the face plate main portion by plastic forming (e.g. press working, bending, casting and forging) a single metal material.

In this embodiment, the main body 1B is integrally molded from a metal material. In the case that the turnback 9 is formed, the main body 1B comprises the above-mentioned hosel portion 7, a major part of the crown 4, a major part of the sole 5, and a major part of the sidewall 6. In the case that the turnback 9 is not formed, the main body 1B comprises the hosel portion 7, the crown 4, the sole 5, and the sidewall 6. Regardless of the turnback 9, an opening is formed at the front of the main body, and the opening is covered with the face plate 1A.

Figure 4:
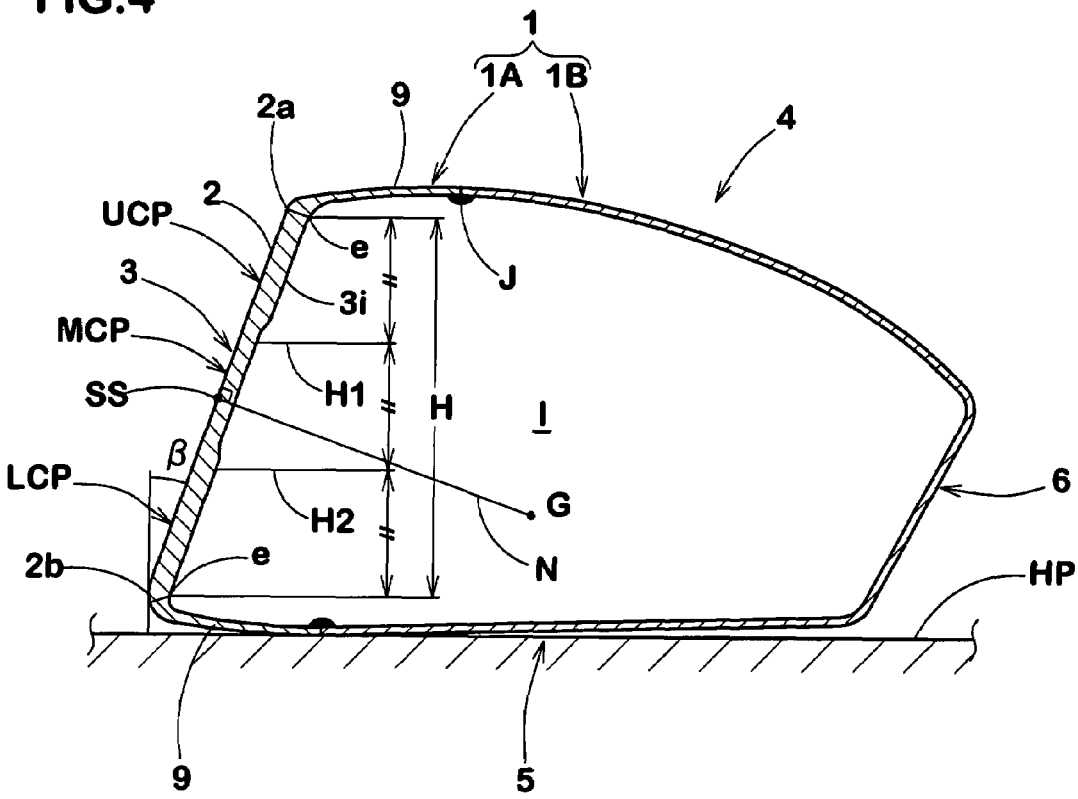
FIG. 4 is a cross sectional view of taken along a line A-A in FIG. 3.

The face plate 1A and the main body 1B are welded as shown in FIG. 4. The turnback 9 which can place the weld junction a away from the face 3, can prevent deterioration of the rebound performance due to the rigid weld junction J or deterioration of the durability due to possible weak points of the weld junction J. Further, the welding operation will be much easier.

As to the metal materials for the face plate 1A and main body 1B, preferably used are metals having a high specific tensile strength such as stainless alloys, maraging steels, pure titanium, titanium alloys, magnesium alloys and aluminum alloys. It is also possible to use a fiber reinforced resin in combination with such metal materials.

In this embodiment, the face plate 1A and main body 1B are made of the same metal material, but this is not critical. Different metal materials can be used.

According to the present invention, the face 3 is provided with a specific thickness distribution. The thickness distribution can be provided by molding, forging, milling and the like. In this example, NC milling is utilized.

Figure 3:
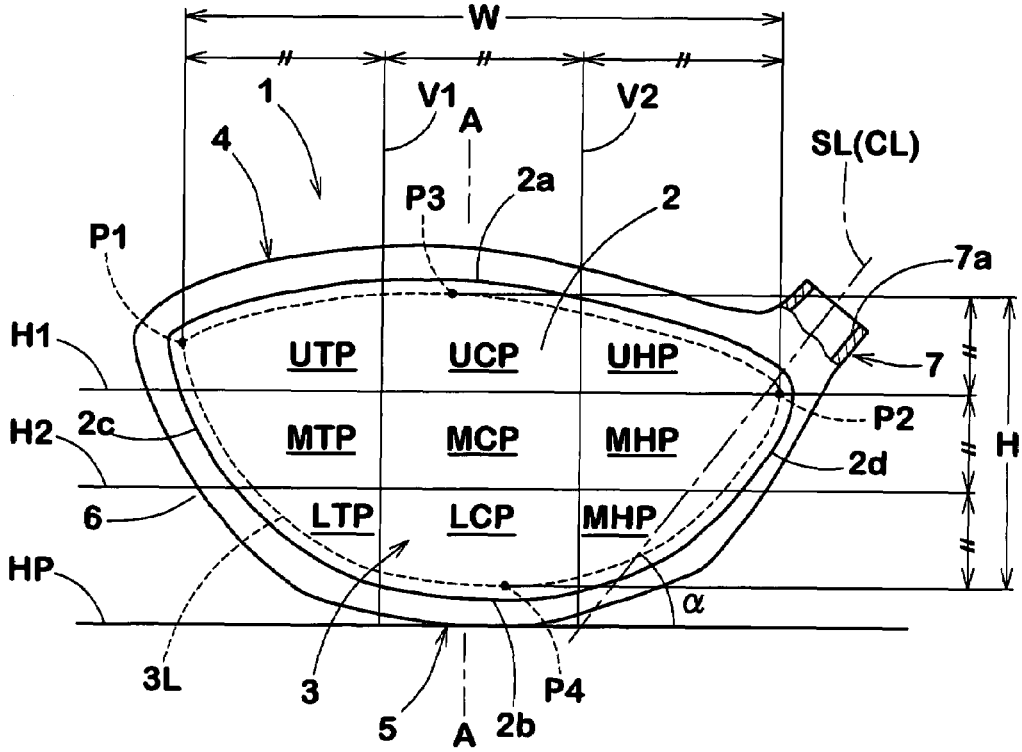
FIG. 3 is a front view thereof.

As shown in FIGS. 3 and 4, the face 3 is sectioned into nine portions by two horizontal planes H1 and H2 and two vertical planes V1 and V2, and the nine average thicknesses of the respective nine portions are set out to satisfy specific relationships (a)-(g):

(a) tUTP<tUCP>tUHP;

(b) tMTP<tMCP>tMHP;

(c) tLTP<tLCP>tLHP;

(d) tUTP>tMTP<tLTP;

(e) tUHP>tMHP<tLHP;

(f) the largest average thickness is 2.8 to 3.5 mm; and (g) the smallest average thickness is 1.6 to 2.3 mm.

The nine portions are as mentioned above:

an upper toe portion UTP; an upper heel portion UHP;

an upper central portion UCP; a middle toe portion MTP;

a middle heel portion MHP; a middle central portion MCP;

a lower toe portion LTP; a lower heel portion LHP; and a lower central portion LCP.

tUTP is the average thickness (mm) of UTP.

tMTP is the average thickness (mm) of MTP.

tLTP is the average thickness (mm) of LTP.

tUHP is the average thickness (mm) of UHP.

tMHP is the average thickness (mm) of MHP.

tLHP is the average thickness (mm) of LHP.

tUCP is the average thickness (mm) of UCP.

tMCP is the average thickness (mm) of MCP.

tLCP is the average thickness (mm) of LCP.

In general, the coefficient of restitution measured at a point on the clubface has a tendency to increase as the rigidity of the neighborhood of the measuring point is decreased. Therefore, by satisfying the conditions (a), (b) and (c):

(a) tUTP<tUCP>tUHP;

(b) tMTP<tMCP>tMHP;

(c) tLTP<tLCP>tLHP, the coefficient of restitution measured in the toe portions UTP, MTP, LTP and heel portions UHP, MHP, LHP can be increased, while preventing the coefficient of restitution in the middle central portion MCP (including sweet spot SS) from increasing. As a result, the high coefficient area can be widened in the toe-heel direction to increase the average of carry distances.

If the average thickness tMTP and tMHP is too small, damage such as cracks becomes liable to occur along the boundary between these portions MTP and MHP and the sidewall 6, and there is possibility that the durability of the face 3 is decreased. If the average thickness tMTP and tMHP is too large, the coefficient of restitution can not be increased, and further the weight of the face 3 is unfavorably increased.

Therefor, each of the average thicknesses tMTP and tMHP is preferably set in a range of not less than 1.6 mm, more preferably not less than 1.7 mm, still more preferably not less than 1.8 mm, but not more than 2.6 mm, more preferably not more than 2.5 mm, still more preferably not more than 2.4 mm.

If the average thickness tUCP and tLCP is too small, it becomes difficult to control the coefficient of restitution of the face 3 so as to comply with the golf rules or regulations. If the average thickness tUCP and tLCP is too large, there is a possibility that the coefficient of restitution of the face 3 decreases drastically.

Therefore, each of the average thicknesses tUCP and tLCP is preferably set in a range of not less than 2.5 mm, more preferably not less than 2.6 mm, still more preferably not less than 2.7 mm, but not more than 3.5 mm, more preferably not more than 3.4 mm, still more preferably not more than 3.3 mm.

If the average thickness tMCP is too small, there is possibility that the coefficient of restitution of the face 3 increases over the limitation by the golf rules, and further the durability of the face 3 will be deteriorated. If the average thickness tMCP is too large, there is a possibility that the coefficient of restitution of the face 3 decreases to decrease the carry distance.

Therefore, the average thickness tMCP is preferably set in a range of not less than 2.3 mm, more preferably not less than 2.4 mm, still more preferably not less than 2.5 mm, but not more than 3.3 mm, more preferably not more than 3.2 mm, still more preferably not more than 3.1 mm.

If the average thicknesses tUTP, tLTP, tUHP and tLHP are too small, the coefficient of restitution of the face 3 is liable to increase over the limitation by the golf rules, and further strength or durability is liable to deteriorate along the boundary between these portions UTP, LTP, UHP and LHP and the crown 4 and sole 5. If the average thicknesses tUTP, tLTP, tUHP and tLHP are too large, the coefficient of restitution of the face 3 decreases to decrease the carry distance.

Therefore, the average thicknesses tUTP, tLTP, tUHP and tLHP are each preferably set in a range of not less than 1.8 mm, more preferably not less than 1.9 mm, still more preferably not less than 2.0 mm, but not more than 2.8 mm, more preferably not more than 2.7 mm, still more preferably not more than 2.6 mm.

Further, the ratio (tMCP/tMTP) and ratio (tMCP/tMHP) are preferably set in a range of not less than 1.1, more preferably not less than 1.2, still more preferably not less than 1.3, but not more than 2.0, more preferably not more than 1.8, still more preferably not more than 1.7.

If the ratio (tMCP/tMTP), (tMCP/tMHP) is less than 1.1, it becomes difficult to widen the high-restitution-coefficient area in the toe-heel direction. If the ratio (tMCP/tMTP), (tMCP/tMHP) is more than 2.0, the rigidity difference or thickness difference between (MCP and MTP), (MCP and MHP) increases, and deformation or stress concentrates on the boundary therebetween, thus the durability of the face 3 is liable to deteriorate.

The ratio (tUCP/tUTP), (tUCP/tUHP), (tLCP/tLTP) and (tLCP/tLHP) is preferably set in a range of not less than 1.1, more preferably not less than 1.2, still more preferably not less than 1.3, but not more than 1.9, more preferably not more than 1.7, still more preferably not more than 1.6.

If the ratio (tUCP/tUTP), (tUCP/tUHP), (tLCP/tLTP) or (tLCP/tLHP) is less than 1.1, it is difficult to improve the COR in the portion UTP, UHP, LTP, LHP, therefore, it is also difficult to widen the high-restitution-coefficient area. If the ratio (tUCP/tUTP), (tUCP/tUHP), (tLCP/tLTP) or (tLCP/tLHP) is more than 1.9, it is difficult to control the COR in the portion MCP so as to comply with the golf rules. Further, the rigidity difference or thickness difference between (UCP and UTP), (UCP and UHP), (LCP and LTP), (LCP and LHP) increases, and deformation or stress concentrates on the boundary therebetween, thus the durability of the face 3 is liable to deteriorate.

According to the present invention, taking the face 3 as a whole, the thickness is decreased in the toe and heel portions (UTP, MTP, LTP, UHP, MHP, LHP), because of the above-mentioned conditions (a), (b) and (c). Therefore, there is a possibility that the strength is decreased between the crown 40 and the portions UTP and UHP, and between the sole 5 and the portions LTP and LHP. However, by satisfying the conditions (d) and (e):

(d) tUTP>tMTP<tLTP;

(e) tUHP>tMHP<tLHP, the decrease in the strength is reduced or prevented, and the durability can be improved.

As to the condition (f), if the largest average thickness tMAX in the above-mentioned nine average thicknesses is less than 2.8 mm, the coefficient of restitution of the face 3 as a whole is very liable to increase over the limitation by the golf rules. Further, it becomes difficult to maintain the necessary durability for the face 3. If on the other hand, the largest average thickness tMAX is more than 3.5 mm, the coefficient of restitution of the face 3 is decreased, and the weight of the face 3 is increased and the design freedom of the center of gravity of the head is lost.

Thus, the largest average thickness tMAX is not less than 2.8 mm, preferably not less than 2.9 mm, but not more than 3.5 mm. Preferably not more than 3.4 mm.

As to the condition (g), if the smallest average thickness tMIN in the above-mentioned nine average thicknesses is less than 1.6 mm, it is difficult to provide necessary durability for the face 3. If the smallest average thickness tMIN is more than 2.3 mm, the coefficient of restitution of the face 3 is decreased, and it becomes difficult to widen the high-restitution-coefficient area. Further, the weight of the face 3 tends to increase.

Thus, the smallest average thickness tMIN is not less than 1.6 mm, preferably not less than 1.7 mm, but not more than 2.3 mm, preferably not more than 2.2 mm.

If the difference in the average thickness between the upper portions (UTP, UHP, UCP) and the lower portions (LTP, LHP, LCP) is large, the rigidity balance is lost, and deformation/distortion tends to concentrate in the upper portions or lower portions. From this point of view, the ratios (tUCP/tLCP), (tUTP/tLTP) and (tUHP/tLHP) are preferably set in a range of not less than 0.8, but not more than 1.3.

On the other hand, if a ball is struck at a point in the lower portions (LTP, LHP, LCP), there is a tendency that a large amount of backspin is given to the struck ball due to a vertical gear effect which results in a loss of the carry distance. This type of carry loss can be reduced by making the average thicknesses of the lower portions smaller than the average thicknesses of the upper portions, respectively. From this standpoint, therefore, it is preferable that the above-mentioned ratios (tUCP/tLCP), (tUTP/tLTP) and/or (tUHP/tLHP) are more than 1.0, more preferably not less than 1.1.

Furthermore, if the difference in the average thickness between the heel portions (UHP, MHP, LHP) and the toe portions (UTP, MTP, LTP) is large, the rigidity balance is lost, and deformation/distortion tends to concentrate in the heel portions or toe portions. Therefore, the ratios (tMTP/tMHP), (tUTP/tUHP) and (tLTP/tLHP) are preferably set in a range of not less than 0.8, but not more than 1.3.

In general, the head speed at the ball impact point becomes lower in the heel portions than in the toe portions, and as a result, the carry distance has a tendency to decrease when hitting at the heel portions than the toe portions. This type of decrease in the carry distance can be minimized by increasing the coefficient of restitution in the heel portions. From this point of view, it is more preferable that the radios (tMTP/tMHP), (tUTP/tUHP) and (tLTP/tLHP) are more than 1.0, preferably not less than 1.1.

Figure 5:
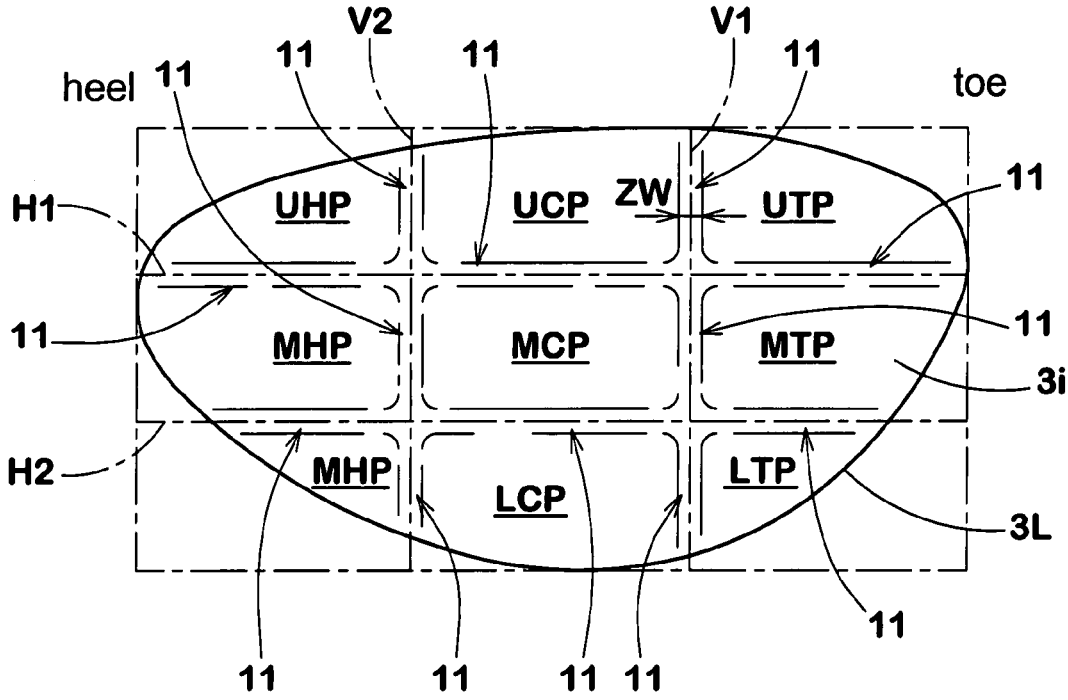
FIG. 5 is a rear view of the face showing a thickness distribution according to the present invention.
Figure 6:
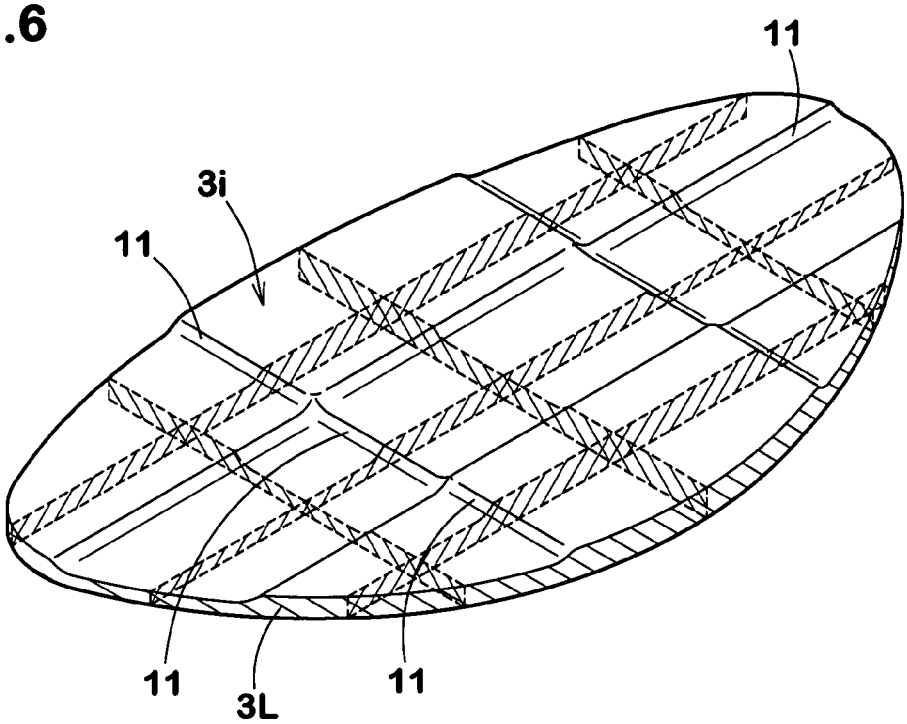
FIG. 6 is a perspective view thereof.
Figure 7:
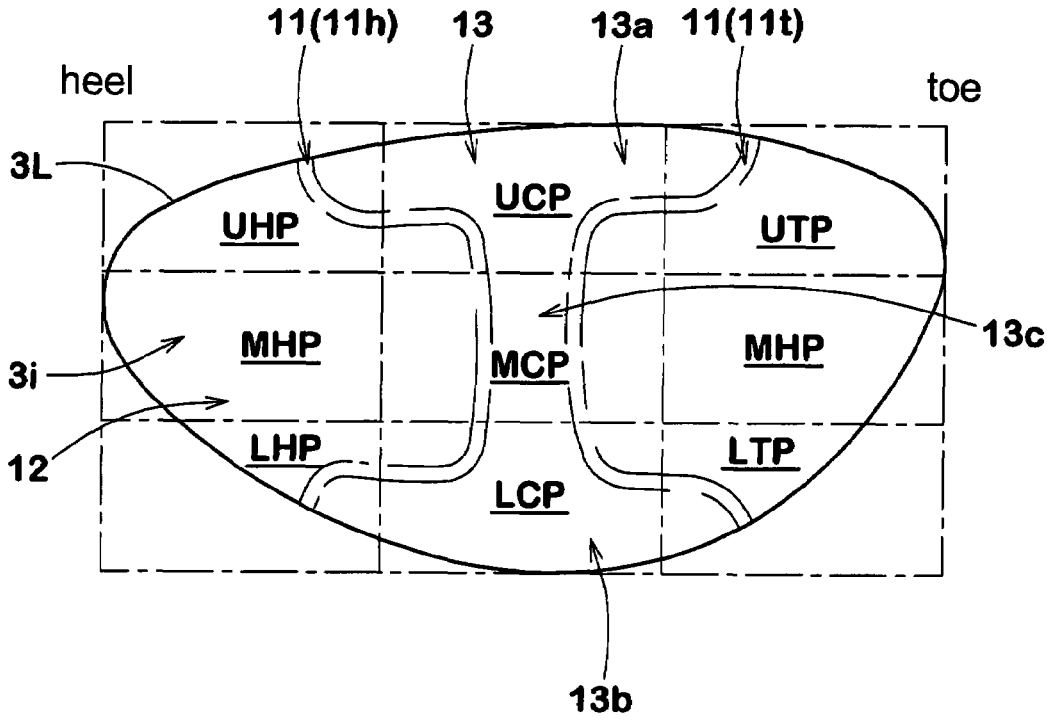
FIG. 7 is a rear view of the face showing another example of the thickness distribution according to the present invention.
Figure 8:
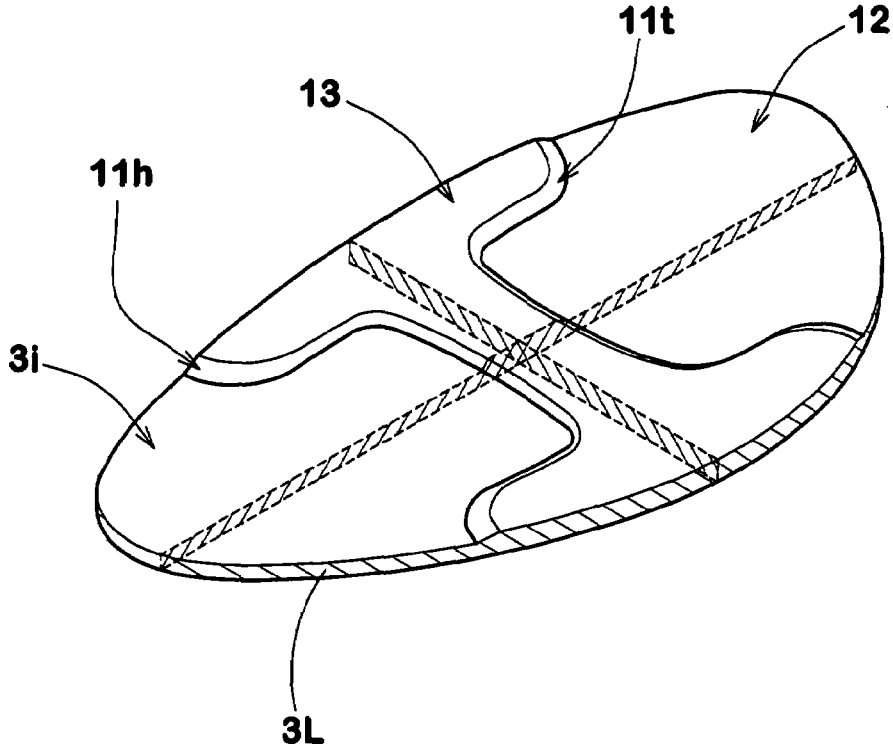
FIG. 8 is a perspective view thereof.
Figure 9A:
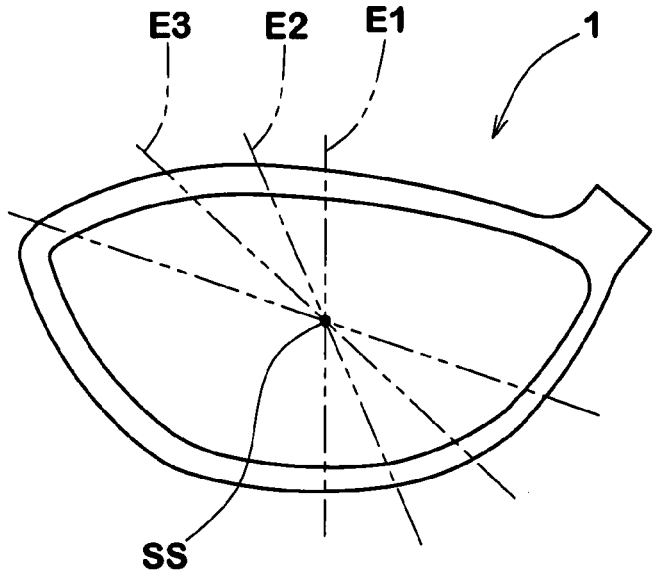
FIGS. 9(A) and 9(B) are a front view and a cross sectional view of the face for explaining the definition of the edge of the clubface.
Figure 9B:
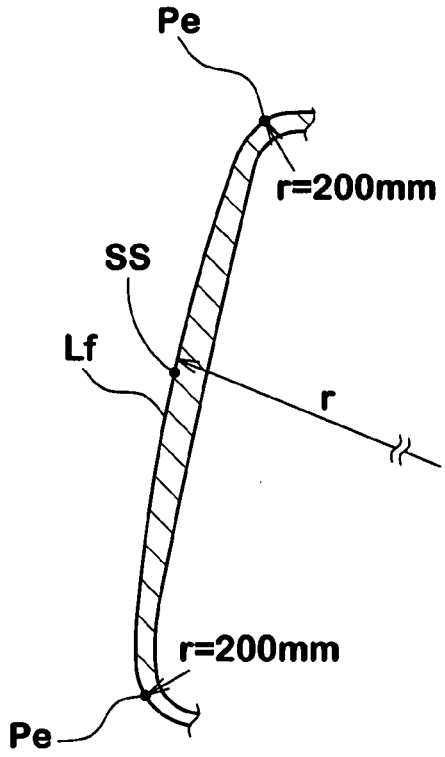
Figure 10:
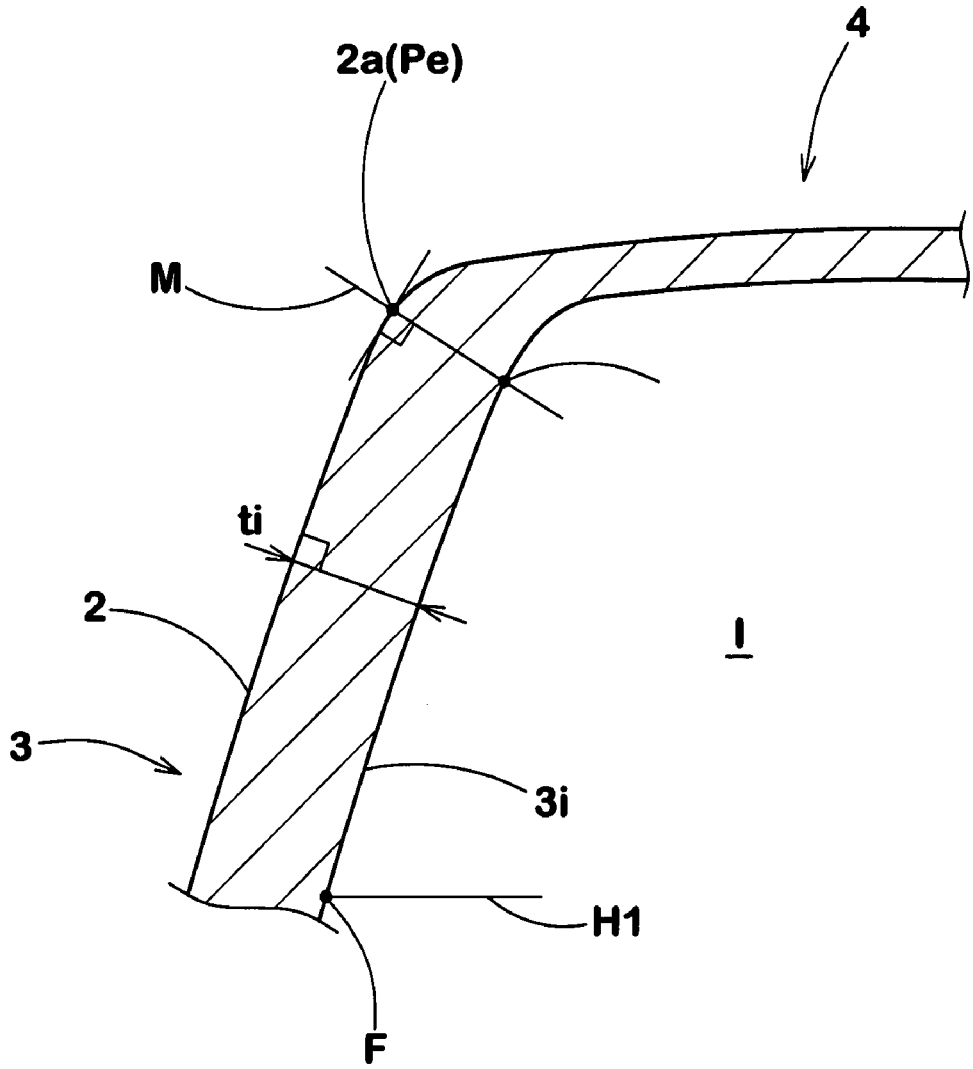
FIG. 10 is an enlarged partial cross sectional view of the face for explaining the definition of the edge of the backside of the face.

FIGS. 4-6 shows an example of the thickness distribution, and FIGS. 7-8 shows another example of the thickness distribution.

In FIGS. 4-6, at least 80% in area of each of the nine portions (UTP, UHP, UCP, MTP, MHP, MCP, LTP, LHP, LCP) has a substantially constant thickness, and thickness transitional zones 11 therebetween are formed on the backside 3*i* of the face 3 so as to coincide with the boundaries (V1, V2, H1 and H2) between the nine portions. Therefore, the thickness transitional zones 11 in this example are arranged in a form of a double cross. The thickness transitional zones 11 have slant faces smoothly connecting the back surfaces of the adjacent portions having different thicknesses. Preferably, the width ZW of the thickness transitional zones 11 is set in a range of from 5 to 15 times the thickness difference between the adjacent portions in order to avoid a large stress concentration.

In FIGS. 7-8, in contrast to the former example, the thickness transitional zones 11 do not coincide with the boundaries (V1, V2, H1 and H2) between the nine portions. The face 3 comprises a thin part 12 having a substantially constant thickness (tMIN), a thick part 13 having a substantially constant thickness (tMAX), and the thickness transitional zones 11.

The thickness transitional zones 11 in this example include a toe-side thickness transitional zone lit and a heel-side thickness transitional zone 11*h*. The toe-side thickness transitional zone lit extends from the upper edge to the lower edge of the backside 3*i* through the five portions UTP, UCP, MCP, LCP and LTP. The heel-side thickness transitional zone 11*h* extends from the upper edge to the lower edge of the backside 3*i* through the five portions UHP, UCP, MCP, LCP and LHP, three of which are common to the toe-side thickness transitional zone 11*t*.

The thick part 13 is formed between the toe-side and heel-side thickness transitional zones 11*t* and 11*h* so as to includes: a upper thick part 13*a* extending along the upper edge of the backside 3*i* from a middle point of the UHP to a middle point of the UTP; a lower thick part 13*b* extending along the lower edge of the backside 3*i* from a middle point of the LHP to a middle point of the LTP; and a narrower vertical thick part 13*c* extending between the upper and lower thick parts 13*a* and 13*b* through the MCP. As a result, the thick part 13 has a shape of capital H rotated by 90 degrees.

In order to satisfy the above-mentioned condition (a) "tUTP<tUCP>tUHP", with respect to the percentage of the occupied area of the thick part 13 in each of the portions UTP, UHP and UCP, a relationship "UTP<UCP>UHP" is satisfied. Further, in order to satisfy the condition (c) "tLTP<tLCP>tLHP", with respect to the percentage of the occupied area of the thick part 13 in each of the portions LTP, LCP and LHP, a relationship "LTP<LCP>LHP" is satisfied.

Furthermore, to satisfy the condition (b) "tMTP<tMCP>tMHP", with respect to the percentage of the occupied area of the thick part 13 in each of the portions MTP, MCP and MHP, a relationship "MTP<MCP>MHP", particularly "MTP=0<MCP>MHP=0", is satisfied.

similarly, a relationship "UTP>MTP<LTP" and a relationship "UHP>MHP<LHP" are satisfied to meet the other conditions (d) and (e).

Comparison Tests

Wood-type golf club heads (volume 460 cc, loft 11 degrees) were made and tested for the carry distance and durability.

Except for the thickness distributions, all the heads had identical two-piece structures each composed of an open-front main body and a face plate with a turnback as shown in FIG. 4. The main body was a precision casting of Ti-6Al-4V. The face plate was formed by press forming a rolled plate of Ti-6Al-4V. The main body and face plate were plasma-arc welded. The thickness variations were given by a numerical controlled milling machine tool.

In Exs. 1 to 3 and Refs. 1 and 2, as shown in FIGS. 5 and 6, the thickness transitional zones were arranged in a form of a double cross and each of the nine portions had a substantially constant thickness.

Ex. 4 had a H-shaped thick part as shown in FIGS. 7 and 8.

Ref. 3 had a constant thickness throughout the face.

In Exs. 1 to 4 and Refs. 1 and 2, the thickness transitional zones had widths each being substantially 10 times the thickness difference between the adjacent portions.

Carry Distance Test and Durability Test:

The heads were attached to identical FRP shafts to make 45-inch drivers, and each club was attached to a swing robot and repeatedly struck a ball at a head speed of 45 m/s while changing the impact point. The impact point was the following five points at (1) the sweet spot SS in MCP, (2) 30 mm toe-side of SS in MTP, (3) 30 mm heel-side of SS in MHP, (4) 15 mm upside of SS in UCP and (5) 15 mm downside of SS in LCP. At each of the impact points, five shots were made to obtain the average carry distance. The results are shown in Table 1.

Further, using the same swing robot and club, a durability test was carried out with an increased head speed of 54 m/s and the impact point fixed to the sweet spot SS. In the test, golf balls were struck successively up to 5000 times. The results are indicated in Table 1, wherein "OK" means that there was no damage after the 5000 shots. "NO" means that the face was broken before reaching to 5000 shots.

As apparent from the test results, the average carry distances of the example heads were significantly increased when compared with the reference heads, and with respect to the durability, the example heads compared favorably with the reference heads.

TABLE 1

| Head | Ex. 1 | Ex. 2 | Ex. 3 | Ex. 4 | Ref. 1 | Ref. 2 | Ref. 3 |
|---|---|---|---|---|---|---|---|
| tUTP (mm) | 2.3 | 2.4 | 2.4 | 2.3 | 2.1 | 3.3 | 3.2 |
| tMTP (mm) | 2.1 | 2.1 | 2.1 | 2.1 | 2.4 | 3.1 | 3.2 |
| tLTP (mm) | 2.3 | 2.2 | 2.4 | 2.3 | 2.1 | 3.3 | 3.2 |
| tUCP (mm) | 3.2 | 3.3 | 3.2 | 3.2 | 3.2 | 3.0 | 3.2 |
| tMCP (mm) | 3.0 | 3.0 | 3.0 | 3.0 | 3.0 | 2.8 | 3.2 |
| tLCP (mm) | 3.2 | 3.1 | 3.2 | 3.2 | 3.2 | 3.0 | 3.2 |
| tUHP (mm) | 2.3 | 2.4 | 2.2 | 2.3 | 2.1 | 3.3 | 3.2 |
| tMHP (mm) | 2.1 | 2.1 | 2.1 | 2.1 | 2.4 | 3.1 | 3.2 |
| tLHP (mm) | 2.3 | 2.2 | 2.2 | 2.3 | 2.1 | 3.3 | 3.2 |
| tMCP/tMTP | 1.4 | 1.4 | 1.4 | 1.4 | 1.3 | 0.9 | 1.0 |
| tMCP/tMHP | 1.4 | 1.4 | 1.4 | 1.4 | 1.3 | 0.9 | 1.0 |
| tUCP/tUTP | 1.4 | 1.4 | 1.3 | 1.4 | 1.5 | 0.9 | 1.0 |
| tUCP/tUHP | 1.4 | 1.4 | 1.5 | 1.4 | 1.5 | 0.9 | 1.0 |
| tLCP/tLTP | 1.4 | 1.4 | 1.3 | 1.4 | 1.5 | 0.9 | 1.0 |
| tLCP/tLHP | 1.4 | 1.4 | 1.5 | 1.4 | 1.5 | 0.9 | 1.0 |
| tUCP/tLCP | 1.0 | 1.1 | 1.0 | 1.0 | 1.0 | 1.0 | 1.0 |
| tUTP/tLTP | 1.0 | 1.1 | 1.0 | 1.0 | 1.0 | 1.0 | 1.0 |
| tUHP/tLHP | 1.0 | 1.1 | 1.0 | 1.0 | 1.0 | 1.0 | 1.0 |
| tMTP/tMHP | 1.0 | 1.0 | 1.0 | 1.0 | 1.0 | 1.0 | 1.0 |
| tUTP/tUHP | 1.0 | 1.0 | 1.1 | 1.0 | 1.0 | 1.0 | 1.0 |
| tLTP/tLHP | 1.0 | 1.0 | 1.1 | 1.0 | 1.0 | 1.0 | 1.0 |
| tMTP/tUTP | 0.9 | 0.9 | 0.9 | 0.9 | 1.1 | 0.9 | 1.0 |
| tMTP/tLTP | 0.9 | 1.0 | 0.9 | 0.9 | 1.1 | 0.9 | 1.0 |

TABLE 1-continued

| Head | Ex. 1 | Ex. 2 | Ex. 3 | Ex. 4 | Ref. 1 | Ref. 2 | Ref. 3 |
|---|---|---|---|---|---|---|---|
| tMHP/tUHP | 0.9 | 0.9 | 1.0 | 0.9 | 1.1 | 0.9 | 1.0 |
| tMHP/tLHP | 0.9 | 1.0 | 1.0 | 0.9 | 1.1 | 0.9 | 1.0 |
| tMAX (mm) | 3.2 | 3.3 | 3.2 | 3.5 | 3.2 | 3.3 | 3.2 |
| tMIN (mm) | 2.1 | 2.1 | 2.1 | 2.1 | 2.1 | 2.8 | 3.2 |
| Weight of Face (g) | 48 | 48 | 48 | 46 | 48 | 54 | 57 |
| Carry distance (yard) | | | | | | | |
| Sweet spot | 251 | 250 | 252 | 252 | 250 | 248 | 247 |
| 30 mm toe-side | 242 | 240 | 241 | 246 | 237 | 233 | 236 |
| 30 mm heel-side | 236 | 237 | 240 | 241 | 232 | 227 | 230 |
| 15 mm upside | 247 | 246 | 247 | 248 | 247 | 244 | 243 |
| 15 mm downside | 240 | 245 | 241 | 242 | 241 | 239 | 237 |
| Average | 243 | 244 | 244 | 246 | 241 | 238 | 239 |
| Durability | OK | OK | OK | OK | NO | NO | OK |

The invention claimed is:

1. A wood-type hollow golf club head comprising a face having a front surface forming a clubface and a backside facing a hollow, said face having a thickness distribution satisfying the following conditions: (a) tUTP<tUCP>tUHP; (b) tMTP<tMCP>tMHP; (c) tLTP<tLCP>tLHP, wherein tUTP is an average thickness of an upper toe portion UTP, tUCP is an average thickness of an upper central portion UCP, tUHP is an average thickness of an upper heel portion UHP, tMTP is an average thickness of a middle toe portion MTP, tMCP is an average thickness of a middle central portion MCP, tMHP is an average thickness of a middle heel portion MHP, tLTP is an average thickness of a lower toe portion LTP, tLCP is an average thickness of a lower central portion LCP, and tLHP is an average thickness of a lower heel portion LHP, and further (d) tUTP>tMTP<tLTP; and (e) tUHP>tMHP<tLHP; and in the above nine average thicknesses, (f) the largest average thickness is 2.8 to 3.5 mm; and (g) the smallest average thickness is 1.6 to 2.3 mm, wherein said wood-type hollow golf club head further satisfies the following condition: (h) tUCP>tMCP<tLCP.

2. The wood-type hollow golf club head according to claim 1, which further satisfy the following condition: (i) tUCP>tLCP.

3. The wood-type hollow golf club head according to claim 1, which further satisfy the following condition: (j) tMTP>tMHP.

4. The wood-type hollow golf club head according to claim 1, which further satisfy the following conditions: (k) tUTP>tUHP; and (l) tLTP>tLHP.

* * * * *